United States Patent [19]

Frenchik

[11] 4,374,921

[45] Feb. 22, 1983

[54] IMAGE ENHANCEMENT OF PHOTOTHERMOGRAPHIC ELEMENTS

[75] Inventor: Robert A. Frenchik, Sommerset, Wis.

[73] Assignee: Minnesota Mining and Manufacturing Company, St. Paul, Minn.

[21] Appl. No.: 271,408

[22] Filed: Jun. 8, 1981

[51] Int. Cl.[3] ..... G03C 1/52; G03C 1/02

[52] U.S. Cl. ..... 430/338; 430/523; 430/617; 430/559; 430/620; 430/618; 430/619

[58] Field of Search ..... 430/559, 618–620, 430/338, 340, 342, 523, 617; 428/913, 332

[56] References Cited

U.S. PATENT DOCUMENTS

| | | | |
|---|---|---|---|
| 3,180,731 | 4/1965 | Roman et al. | 96/29 |
| 3,445,234 | 5/1969 | Cescon et al. | 430/332 |
| 3,531,286 | 9/1970 | Renfrew | 96/67 |
| 3,985,565 | 10/1976 | Gabrielsen et al. | 96/114.1 |
| 4,021,240 | 5/1977 | Cerquone et al. | 96/29 D |
| 4,021,249 | 5/1977 | Noguchi et al. | 96/114.1 |
| 4,022,617 | 5/1977 | McGuckin | 96/29 D |
| 4,123,282 | 10/1978 | Winslow | 96/114.1 |
| 4,187,108 | 2/1980 | Willis | 430/203 |

OTHER PUBLICATIONS

Research Disclosure 17029, Jun. 1978, James W. Carpenter & Paul W. Lauf.

Research Disclosure 15676, Apr. 1977, Roland G. Willis.

Research Disclosure 14433, Apr. 1976, Edwin N. Oftendahl et al.

Research Disclosure 13443, Jun. 1975, Hugh G. McGuckin.

Research Disclosure 15126, Nov. 1976, R. S. Garielsen et al.

*Primary Examiner*—Won H. Louie, Jr.

*Attorney, Agent, or Firm*—Cruzan Alexander; Donald M. Sell; Mark A. Litman

[57] ABSTRACT

A photothermographic emulsion can be provided with enhanced image density by using an indoaniline leuco dye, aromatic carboxylic acid, and p-alkylphenyl sulfonic acid in reactive association with the emulsion.

9 Claims, No Drawings

IMAGE ENHANCEMENT OF PHOTOTHERMOGRAPHIC ELEMENTS

TECHNICAL FIELD

The present invention relates to silver halide photothermographic emulsions and in particular to image enhancement and color formation of photothermographic emulsions by oxidation of leuco dyes.

BACKGROUND OF THE ART

Silver halide photothermographic imaging materials, often referred to as 'dry silver' compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and U.S. Pat. No. 4,260,677 discloses the use of complexes of inorganic or organic silver salts as image source materials.

In both photographic and photothermographic emulsions, exposure of the silver halide to light produces small clusters of silver atoms. The imagewise distribution of these clusters is known in the art as the latent image. This latent image generally is not visible by ordinary means and the light sensitive article must be further processed in order to produce a visual image. The visual image is produced by the catalytic reduction of silver ions which are in catalytic proximity to the specks of the latent image.

As the visible image is produced entirely by silver, one cannot readily reduce the amount of silver in the emulsion without reducing the available maximum image density. Reduction of the amount of silver is desirable in order to reduce the cost of raw materials used in the emulsion.

One traditional way of attempting to increase the image density of photographic and photothermographic emulsions without increasing or while decreasing the amount of silver in the emulsion layer is by the addition of dye forming materials into the emulsion.

U.S. Pat. No. 4,021,240 discloses the use of sulfonamidophenol reducing agents and four equivalent photographic color couplers in thermographic and photothermographic emulsions to produce dye images.

U.S. Pat. No. 4,022,617 discloses the use of leuco dyes (referred to as leuco base dyes) in photothermographic emulsions. These leuco dyes are oxidized to form a color image during the heat development of the photothermographic element. A number of useful toners and development modifiers are also disclosed.

Various color toning agents which modify the color of the silver image of photothermographic emulsions and darken it to a black or blue-black image are also well known in the art as represented by U.S. Pat. Nos. 4,123,282; 3,994,732; 3,846,136 and 4,021,249.

U.S. Pat. No. 3,985,565 discloses the use of phenolic type photographic color couplers in photothermographic emulsions to provide a color image.

U.S. Pat. No. 3,531,286 discloses the use of photographic phenolic or active methylene color couplers in photothermographic emulsions containing p-phenylenediamine developing agents to produce dye images.

Research Disclosure 17029, "Photothermographic Silver Halide Systems," published June 1978, pp. 9–15, gives a brief history of photothermographic systems and discusses attempts to provide color to them. Many of these previously discussed patents and other art such as U.S. Pat. Nos. 4,022,617; 3,180,731 and 3,761,270 are noted as relevant to the subject of providing dye density and color images to photothermographic emulsions.

One problem which has been encountered in the construction of these systems is the traditional problem of balancing the development rate of the emulsion with the shelf-stability of the emulsion. The more rapidly color may be developed in the emulsion during thermal development, the greater tendency the emulsion has to form dyes without exposure and heating. Classically, whatever one does to speed up the rate of color formation tends to increase the formation of spurious dye images (i.e., background coloration). The use of fast coupling color couplers or easily oxidizable leuco dyes in photothermographic systems consistently tends to increase the amount of spurious dye imaging which occurs. This is analogous to fog in photographic emulsions.

It would be desirable to have high speed color image or color enhanced image photothermographic emulsion without loss of shelf stability.

SUMMARY OF THE INVENTION

A photothermographic emulsion comprising a binder, silver source material, photosensitive silver halide and reducing agent for silver ion can be color enhanced or provided with color without increased fog by using reduced indoaniline leuco dyes in combination with an aromatic carboxylic acid and an p-alkylphenylsulfonic acid.

DETAILED DESCRIPTION OF THE INVENTION

Photothermographic emulsions are usually constructed as one or two layers on a substrate. Single layer constructions must contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and the other ingredients in the second layer or both layers.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant for silver ion of between 4.0 and 10.0 are also desirable. The silver source material should constitute from about 5 to 70 and preferably from 7 to 30 percent by weight of the imaging layer. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fasion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

The reducing agent for silver ion is the reduced indoaniline leuco dye used in the present invention, which will reduce silver ion to metallic silver. Conventional photographic developers such as phenidone, hydroquinones, and catechol are useful in minor amounts, and hindered phenol reducing agents may also be added. The reducing agent should be present as 1 to 10 percent by weight of the imaging layer. In a two-layer construction, if the reducing agent is in the second layer, slightly higher proportions, of from about 2 to 15 percent tend to be more desirable.

Toners such as phthalazinone, and both phthalazine and phthalic acid, and others known in the art, are not essential to the construction, but are highly desirable. These materials may be present, for example, in amounts of from 0.2 to 5 percent by weight.

The binder may be selected from any of the well-known natural and synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The polyvinyl acetals, such as polyvinyl butyral and polyvinyl formal, and vinyl copolymers, such as polyvinyl acetate/chloride are particularly desirable. The binders are generally used in a range of from 20 to 75 percent by weight of each layer, and preferably about 30 to 55 percent by weight.

Indoaniline dyes are well known in the photographic art. For example, Mees and James, *The Theory of the Photographic Process,* 3rd Edition, discusses the structure and properties of indoaniline dyes in photographic emulsions (pp. 385–393) and also indicates that the first step in the mechanism of dye formation is the formation of a leuco dye. Indoaniline dyes are also reported in K. Venkataraman, *The Chemistry of Synthetic Dyes,* Vol. II, 1952 (pp. 763 and 1202) and H. A. Lubs, *The Chemistry of Synthetic Dyes and Pigments,* 1955, p. 263. The use of phenolic leuco dyes in photothermographic emulsions is generally taught in U.S. Pat. No. 3,985,565, but there is no disclosure of indoaniline leuco dyes. Research disclosure 15126 (November 1976) R. S. Gabrielsen et al. discloses the use of azomethine leuco dyes which are structurally similar to inodoaniline leuco dyes but are believed to be less readily oxidized to a color form. Indoaniline dyes are thought to have been avoided in photothermographic constructions because of their well known reactivity which renders them unstable in oxidation systems.

The basic nuclear structure which identifies indoaniline dyes is

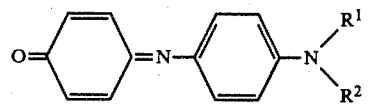

The general nuclear structure for the leuco dyes is

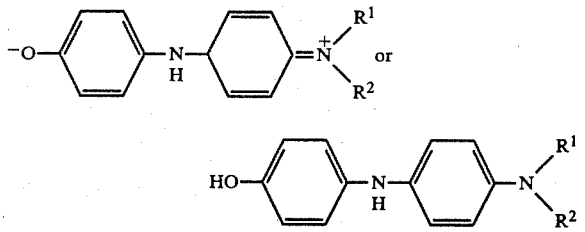

according to various literature source materials. The groups $R^1$ and $R^2$ may be independently selected from hydrogen, alkyl groups and aryl groups. Preferably the alkyl groups are from 1 to 20 carbon atoms, more preferably 1 to 12 carbon atoms and most preferably 1 to 4 carbon atoms. The aryl group preferably have up to 20 carbon atoms, more preferably up to 16 carbon atoms and most preferably six carbon atoms and are phenyl groups. Both the otho and meta positions on the phenol and the amino substituted rings may be generally substituted as is well known in the art. In the present invention it has been surprisingly found that a limited class of these indoaniline leuco dyes may be rendered stable in photothermographic silver halide systems according to the present invention. In a general formula, the structural formula for the useful indoaniline leuco dyes

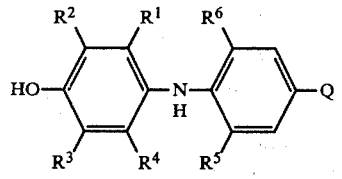

$R^1$, $R^4$, $R^5$ and $R^6$ may be independently selected from hydrogen, alkyl groups of 1 to 20 carbon atoms (preferably 1 to 4 carbon atoms), and alkoxy groups of 1 to 20 carbon atoms (preferably 1 to 4 carbon atoms). $R^2$ and $R^3$ may be H or halogen (preferably Cl or Br, most preferably Cl). Q may be dialkylamino (preferably alkyl of 1 to 20, more preferably 1 to 4 carbon atoms) or acetamide. At least two of $R^1$, $R^2$, $R^3$, and $R^4$ must be hydrogen. It is surprisingly that compounds beyond these structures were not found to be stabilized according to the present invention.

Aromatic carboxylic acids and their anhydrides are well known. Essentially they are any aromatic ring group having at least one carboxylic acid group thereon. A general common nucleus for such a compound would be

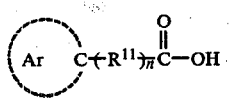

wherein $R^{11}$ is an aliphatic group or preferably an alkylene group of 1 to 20 carbons and more preferably 1 to 3 carbon atoms, n is 0 or 1, and Ar represents an aromatic nucleus with group $—R^{11}—_nCOOH$ bonded to a carbon atoms in the nucleus.

A more preferred chemical formula for the aromatic carboxylic acids would be

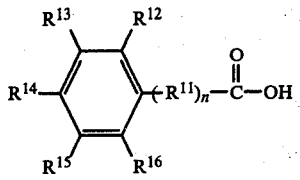

wherein $R^{11}$ and n are as defined above, $R^{12}$–$R^{16}$ are independently selected from hydrogen, alkyl groups, alkoxy groups, aryl groups, alkaryl groups, carboxylic acid groups (e.g., $—R^{11}—_nCOOH$, particularly when n=O), halogen, amino groups and the like and where adjacent groups (e.g., $R^{12}$ and $R^{13}$, and $R^{13}$ and $R^{14}$) may be the atoms necessary to form a fused aromatic group (preferably a benzene ring) or heterocyclic group (e.g., of 5 to 7 ring atoms preferably selected from C, N, S and O atoms). Preferably these substituents have 20 or fewer carbon atoms. Ring groups more preferably have 16 or fewer carbon atoms and most preferably have 6 or fewer carbon atoms and are phenyl groups. Aliphatic groups (alkyl and alkoxy groups as well as substituents on amino groups) are preferably of 1 to 20 carbon atoms, more preferably of 1 to 8 carbon atoms and most preferably of 1 to 4 carbon atoms.

Representative aromatic carboxylic acids and their anhydrides include phthalic acid, 1,2,4-benzenetricarboxylic acid, 2,3-naphthalene dicarboxylic acid, tetrachlorophthalic acid, 4-methyl phthalic acid, homophthalic acid, 4-nitro phthalic acid, o-phenylacetic acid, naphthoic acid, naphthalic acid, phthalic anhydride, naphthalic anhydride, tetrachlorophthalic anhydride, and the like.

Where the term 'group' is used in describing substituents, substitution is anticipated on the substituent. For example, alkyl group includes ether groups (e.g., $CH_3—CH_2—O—CH_2—$), haloalkyls, nitroalkyls, carboxyalkyls, hydroxyalkyls, etc. while the term alkyl includes only hydrocarbons. Substituents which react with active ingredients, such as very strong reducing or oxidizing substituents, would of course be excluded as not being sensitometrically inert or harmless. Sensitometrically inert means that the substituent will not destroy the imaging ability of the construction.

The p-alkylphenyl sulfonic acid compounds are well known in the art. These compounds have a common nucleus of

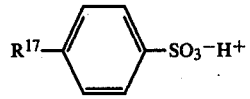

wherein $R^7$ is an alkyl group of up to 20 carbon atoms, preferably 1 to 10 carbon atoms, more preferably 1 to 3 carbon atoms and most preferably methyl so that the compound is a para-toluene sulfonic acid. All positions on the phenyl ring may be substituted with sensitometrically inert groups such as alkyl, alkoxy, halogen, and the like (with group sizes within the range of those for groups $R^{12}$–$R^{16}$). It is most preferred that the compound be p-toluene sulfonic acid.

Various other conventional additives to photothermographic emulsions may also be present in the system. Normal addenda such as acutance dyes, stabilizers, accelerators, flow control aids and surfactants, toners, mercury salts, and the like are desirable in the ordinary practice of the present invention.

The leuco dyes are generally present as from 0.5 to 25 percent by weight of the imaging layer, preferably from 0.75 to 10 percent by weight and more preferably as 1 to 7 percent by weight of the imaging layer. The aromatic acid is generally present as from 0.005 to 5 percent by weight of the imaging layer, preferably from 0.05 to 2 percent and more preferably as 0.10 to 1 percent by weight of the imaging layer. The p-alkylphenyl sulfonic acid is generally present as from 0.002 to 5 percent by weight, preferably from 0.05 to 2 percent, and more preferably from 0.1 to 1 percent by weight of the imaging layer.

These and other aspects of the present invention will be shown in the following examples.

The leuco dyes used in the present invention can be readily produced by conventional synthetic procedures and because of their susceptibility to aerial oxidation, they should be handled carefully. For example, the indoaniline dyes can be readily reduced in ethanol using ascorbic acid. The leuco dyes should then be immediately stabilized with the p-alkylphenyl sulfonic acid. The solution of dye and aromatic sulfonic acid may then be added to a resin binder with the aromatic carboxylic acid to be used as a top coat or as the emulsion layer (with the addition of a silver source material, photographic silver halide and reducing agent for silver ion).

EXAMPLE 1

54.54 grams of a 15% silver soap dispersion in acetone (of behenic acid and silver behenate) was diluted with 25.75 grams of toluene. Then 0.008 grams of polyvinylbutyral was added and this composition mixed for 10 minutes. The halide addition was with 0.042 grams of zinc bromide dissolved in 0.334 grams of methanol with a 30 minute mix time. A second halide addition was made with the same concentration and mix time. An additional 11.17 grams of polyvinylbutyral was added, and then 0.0017 grams of green sensitizing dye A plus 0.0034 grams of blue sensitizing dye B dissolved in 2.77 grams of methanol were added 30 minutes later with mixing. This final mixture was coated onto a paper base at 1.10 grams per square foot to give 65 milligrams of silver per square foot.

Dye A and dye B respectively have the following formulae:

(A)

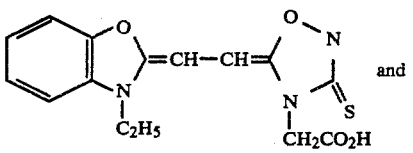

and (B)

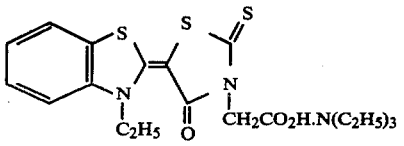

A resin premix solution for the silver coating was prepared as follows: A 5% solution of cellulose acetate was prepared by dissolving 13.5 grams of cellulose acetate in 186.5 grams of acetone, 45.0 grams of methylethylketone, and 28.5 grams of methanol.

A topcoat having the following composition was applied at a 3 mil ($7.60\times10^{-3}$ cm) coating thickness onto Example 1 silver coating.

| Amount (grams) | Ingredient |
|---|---|
| 25 | Resin premix solution of Example 1 |
| 0.10 | 2,2'-methylene-bis-(4-methyl-6-tert-butylphenol) (hereinafter reducing agent No. 1) |
| 0.126 | Phthalazine |
| 0.089 | 4-Methylphthalic Acid |
| 0.043 | Phthalic Anhydride |
| 0.053 | Tetrachlorophthalic Anhydride |

This was dried for three minutes at 170° F. This paper was given a 63.3 second exposure at 158 foot candles on an Eastman Kodak 101 and then developed for a 6 second dwell on a hot roll processor set at 292° F. The resulting image density was 1.60 with a background density of 0.12 using a blue filter.

This Example is to illustrate the image density obtainable with the developer system in Example 5 on a low silver coating weight of 7 milligrams of silver per square foot.

15.05 grams of a 15% silver soap dispersion in acetone (of 47% behenic acid and 53% silver behenate) was diluted with 73.4 grams of ethanol and then 0.012 grams of polyvinylbutyral dissolved in 0.798 grams of ethanol was added. The mixing time was ten minutes before and after the polymer addition. The halidization was in three parts with the first addition being 0.0151 grams zinc bromide dissolved in 0.789 grams of ethanol. This was mixed for 15 minutes. This was repeated two more times with the last addition being mixed for 120 minutes. An addition of 10.0 grams of polyvinylbutyral was mixed for 40 minutes. 50 grams of this solution was diluted with 50 grams of 10% polyvinylbutyral dissolved in ethanol. This solution was spectrally sensitized by the addition of 0.0011 grams of dye A dissolved in 0.0794 grams of methanol and 0.00036 grams of dye B dissolved in 0.1588 grams of methanol. This material was coated onto a paper base to give 7 milligrams of silver per square foot.

A topcoat having the following composition was applied at a 3 mil coating thickness onto this silver coating. The topcoat was dried for 3 minutes at 170° F.

| Amount (grams) | Ingredient |
|---|---|
| 25 | Resin premix solution |
| 1.25 | Reducing agent No. 1 |
| 0.125 | Phthalazine |
| 0.09 | 4-Methylphthalic Acid |

This paper was exposed for 2 seconds to 7700 foot candles of light from a 3M Model 179 light source and then developed for 120 seconds at 280° F. on a 3M Model 70 blanket processor. The resulting Dmax was 0.60 and the Dmin was 0.18 using a blue filter.

EXAMPLE 2

These examples demonstrate the invention in terms of image enhancement on silver coatings. They will also illustrate the stability of a reduced indoaniline cyan dye and the stabilizing effect of the acids. The leuco form of this dye is unstable in solvents and in the dried state.

cyan dye

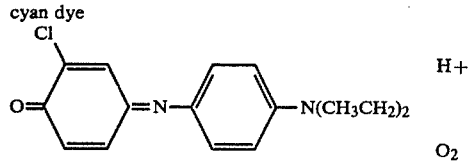

cyan leuco dye

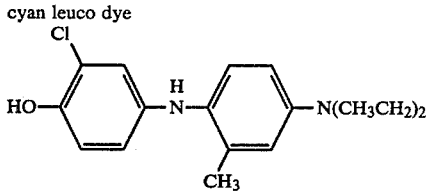

The leuco dye was prepared in the following manner. A reducing solution of 1.08 grams of sodium borohydride dissolved in 50 cc. of N-methyl pyrrolidone was prepared. 30 drops of this were added to a solution of 0.05 grams of the above-identified indoaniline cyan dye dissolved in 5 cc of methanol. The dark blue solution immediately turned brown, but the blue coloration returned in less than 60 minutes. The addition of acetone prevented the dye reduction. The experiment was repeated using 20 drops of the sodium borohydride solution in 2.5 cc of methanol. But this was added immediately after discoloration to a solution of 0.125 grams of p-toluene sulfonic acid dissolved in 25 grams of Example 4 topcoat solution. This solution was kept for 30 days at room temperature without any blue coloration forming.

The same results were obtained when ascorbic acid was used as the reducing agent and p-toluene sulfonic acid was added.

A topcoat was prepared containing the cyan leuco dye (the indoaniline cyan dye reduced with ascorbic acid without the addition of any acids or toners). A solution of 0.10 grams of the indoaniline cyan dye dissolved in 5.0 cc of methanol was prepared and then 0.06 grams of ascorbic acid was added. The solution was immediately added to 25 grams of the resin premix solution of Example 1 after discoloration took place. This was coated onto the 65 mg/ft$^2$ silver coating of Example 1 at a 3 mil thickness and air dried.

This material was given a 63.3 second exposure at 158 foot candles and developed for 6 seconds dwell on a 205° F. hotroll processor to give a blue-green colored image. The Dmax was 0.92 and the Dmin was 0.21 using a red filter.

EXAMPLE 3

The topcoat solution in Example 2 was then coated on the low silver coating of Example 2 (7 milligrams per square foot). This material was given the same exposure as in Example 1 and processed for an 8 second dwell on a 227° F. hotroll processor. The Dmax was 0.29 and the Dmin was 0.19 using a red filter. The image color was green.

EXAMPLE 4

This is the preferred formulation and best illustrates the invention. A topcoat having the following composition in 15% methylethylketone, 15% methanol and 70% acetone was applied at a 3 mil coating thickness onto the low weight silver coating of Example 2.

| Amount | Ingredient |
|---|---|
| 25 grams | Example 1 resin premix solution |
| 0.09 grams | Phthalic Acid |
| 0.05 grams | p-toluene Sulfonic Acid |
| 5.00 cc | Example 2 Leuco Cyan Solution |

This material was given an exposure as in Example 1 and developed at a 30 second dwell time on a 227° F. hotroll processor. The Dmax was 1.49 and the Dmin was 0.22 using a red filter. The image color was blue-green. This material had a 0.89 higher image density than the one in Exmample 1 using reducing agent No. 1. The coatings of this invention have a lower silver weight, thus illustrating image enhancement.

EXAMPLE 5

The topcoat described in Example 4 was coated on top of a low weight silver coating prepared as follows: 7.22 grams of the 15% silver soap dispersion was diluted with 2.87 grams of toluene and 74.40 grams of acetone. This was mixed for 10 minutes. 0.0058 grams of polyvinylbutyral was added, then mixed for 15 minutes. The halidization was in three parts with the first addition being 0.0038 grams of mercuric bromide dissolved in 0.031 grams of methanol. This was mixed for 15 minutes. This was repeated two more times with the same mixing time. The mixer was turned off for two hours before the addition of 15.13 grams of polyvinylbutyral was made. This was mixed in for 60 minutes. The final solution was coated onto a paper base at 0.67 grams per square foot to give 7 milligrams of silver per square foot.

The coating, drying, and light exposure were the same as in Example 4. This material was developed at a 15 second dwell time on a 227° F. hotroll processor. The image color was blue-green with a Dmax of 1.09 and a Dmin of 0.12 using a red filter. This again showed image enhancement.

EXAMPLE 6

The addition of 0.5 grams of phthalazinone to the topcoat composition used in Example 4 and coated on the same low silver weight coating of that Example gave additional image density. This material was developed at a 10 second dwell on a 227° F. hotroll processor. A blue-green image gave a Dmax of 1.23 and a Dmin of 0.13 using a red filter. When the acids were omitted and only phthalazinone was used with the leuco cyan dye, a very faint image was obtained. The Dmax was 0.29 with a Dmin of 0.17 using a red filter.

EXAMPLE 7

This illustrates the increased image enhancement that is obtained when various acids are used to stabilize the leuco indoaniline cyan in solution. A topcoat having the following composition was prepared:

| Amount (grams) | Ingredients |
|---|---|
| 300.0 | Premix Resin Solution of Example 1 |
| 0.84 | Phthalazine |
| 0.60 | Phthalic Acid |
| 1.20 | Tetrachlorophthalic Acid |

Various acid stabilizers for the leuco cyan dye were tested by the addition of the following composition to 25 grams of this topcoat solution:

| Amount | Ingredients |
|---|---|
| 0.10 grams | Cyan Dye of Example 2 |
| 2.50 cc | Methanol (solvent for dye) |
| 18 drops | 2% Sodium Borohydride in N—Methyl-Pyrrolidone |
| 0.125 grams | Stabilizing Acid |
| 1.0 cc | Methanol (solvent for acid) |

The acids tested are listed in the following table with the development conditions on the hotroll processor and the sensitometric responses of the resulting coated paper. These topcoat solutions were coated at a 3 mil thickness on top of the low weight silver coating of Example 4.

| Acid | Development Time @ 280° F. (sec.) | (Red Filter) $D_{max}$ | $D_{min}$ |
|---|---|---|---|
| 1. None | 10 | 0.94 | 0.24 |
| 2. P—Toluene Sulfonic | 6 | 1.07 | 0.15 |
| 3. Phthalic | 10 | 1.65 | 0.21 |
| 4. 4-Nitro Phthalic | 8 | 1.67 | 0.21 |
| 5. Dichloromaleic | 8 | 1.51 | 0.18 |
| 6. 5-sulfosalicylic | 10 | 1.14 | 0.14 |

The following Examples illustrate the use of other phenolic color forming developers which are useful with phthalic acid with or without phthalazine for image enhancement on low silver coatings. These Examples are of topcoat solutions (in 15% methylethylketone, 15% methanol, and 70% acetone) coated at a 3 mil thickness on the Example 3 low silver coating.

EXAMPLE 8

| | | |
|---|---|---|
| Topcoat | 100 grams | Premix Resin Solution of Example 1 |
| Composition: | 0.36 grams | Phthalic Acid |
| | 0.20 grams | p-Toluene Sulfonic Acid |
| | 0.40 grams | Leuco Indoaniline Cyan |

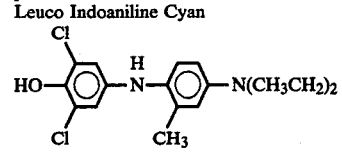

| | |
|---|---|
| Development: | 30 second dwell at 227° F. |
| Density | |

-continued

| | |
|---|---|
| (Red Filter): | 1.36 Dmax; 0.19 Dmin |

EXAMPLE 9

| | | |
|---|---|---|
| Topcoat Composition: | 100 grams | Premix Resin Solution of Example 1 |
| | 0.036 grams | Phthalic Acid |
| | 0.4 grams | Leuco Indoaniline Magenta |

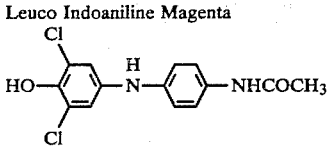

| | |
|---|---|
| Development: | 50 second dwell at 280° F. |
| Density (Blue Filter): | 1.14 Dmax; 0.12 Dmin; Magenta Image |

EXAMPLES 10–13

Example 4 was replicated with equimolar amounts of the following dyes (based on the general structural formula):

| Example | $R^1$ | $R^2$ | $R^3$ | $R^4$ | $R^5$ | $R^6$ | Q |
|---|---|---|---|---|---|---|---|
| 10 | H | Cl | H | H | $CH_3$ | H | $—N(CH_2CH_3)_2$ |
| 11 | H | Cl | Cl | H | $CH_3$ | H | $—(CH_2CH_3)_2$ |
| 12 | $—OCH_3$ | H | H | H | H | $CH_3$ | $—N(CH_2CH_3)_2$ |
| 13 | H | Cl | Cl | H | H | H | $—NHCOCH_3$ |

Each of the constructions were imaged and developed according to Example 4 and displayed both an increased $D_{max}$ and an increased $\Delta D$ (that is, $D_{max}-D_{min}$) than the construction of Example 1.

The use of indoaniline leuco dyes with chlorine groups in the $R^1$ and $R^4$ position (they are equivalent) appeared to greatly reduce the $D_{max}$ and $\Delta D$. The use of a phenyl amine (i.e., $NHC_6H_5$) for group Q conversely raised the $D_{min}$ dramatically, as did the substitution of an hydroxyl group for Q. It is also preferred that only one of $R^5$ and $R^6$ be other than hydrogen.

Combinations of dyes may be used in the same or different layers to produce black images, the reactivity of the dyes being balanced by silver concentrations and the like as understood in the art. Multilayer constructions, equivalent to multilayer photographic constructions may be prepared with organic solvent barrier layers (e.g., organic solvent insoluble resins) between layers. In that construction, different photographic spectral sensitizing dyes would be used in different layers. Full spectrum color images could thus be provided.

I claim:

1. A photothermographic layer comprising a binder, a silver source material, photographic silver halide in catalytic proximity to said silver source material, and a reducing agent for silver ion, characterized by the fact that the reducing agent comprises at least one indoaniline leuco dye having the formula:

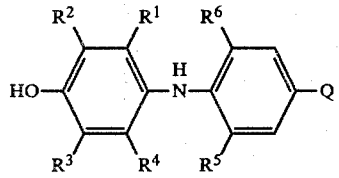

wherein $R^1$=H, alkyl, alkoxy
$R^2$=H, Cl
$R^3$=H, Cl
$R^4$=H, alkyl, alkoxy
$R^5$=H, alkyl, alkoxy
$R^6$=H, alkyl, alkoxy
Q=dialkylamine, acetamide, and
wherein at least two of $R^1$, $R^2$, $R^3$, and $R^4$ must be H; which dye is in the presence of at least one aromatic carboxylic acid and at least one p-alkylphenyl sulfonic acid in reactive associate with said layer.

2. The layer of claim 1 wherein all alkyl and alkoxy groups may be of 1 to 4 carbon atoms and at least one of $R^5$ and $R^6$ are hydrogen.

3. The layer of claim 2 wherein said silver source material is a silver salt of a long chain carboxylic acid having from 10 to 30 carbon atoms.

4. The layer of claim 3 wherein said indoaniline leuco dye, aromatic carboxylic acid and p-alkylphenyl sulfonic acid are in a second layer bonded to and adjacent to said photothermographic layer.

5. The layer of claim 3 wherein said indoaniline leuco dye, aromatic carboxylic acid and p-alkylphenyl sulfonic acid are within the photothermographic layer.

6. The layer of claim 4 wherein said leuco dye comprises from 0.5 to 25 percent by weight of said second layer, the aromatic carboxylic acid comprises from 0.005 to 5 percent by weight of said second layer, and said p-alkylphenyl sulfonic acid comprises from 0.002 to 5 percent by weight of said second layer.

7. The layer of claim 5 wherein said leuco dye comprises from 0.5 to 25 percent by weight of said layer, the aromatic carboxylic acid comprises from 0.005 to 5 percent by weight of said layer, and the p-alkylphenyl sulfonic acid comprises from 0.002 to 5 percent by weight of said layer.

8. The layer of claims 6 or 7 wherein said binder comprises 20 to 75 percent by weight of said acid, the silver source material comprises from 20 to 70 percent by weight of said layer, said photographic silver halide comprises from 0.75 to 15 percent by weight of said layer, and said reducing agent comprises from 1 to 15 percent by weight of said layer.

9. The layer of claims 4, 5 or 7 wherein a toner comprising phthalazine and a phthalic acid are present in said second layer, and said p-alkylphenyl sulfonic acid is p-toluene sulfonic acid.

* * * * *